US010980707B2

(12) United States Patent
Kong

(10) Patent No.: US 10,980,707 B2
(45) Date of Patent: Apr. 20, 2021

(54) BIDET DEVICE

(71) Applicant: Byung Seung Kong, Seoul (KR)

(72) Inventor: Byung Seung Kong, Seoul (KR)

( * ) Notice: Subject to any disclaimer, the term of this patent is extended or adjusted under 35 U.S.C. 154(b) by 0 days.

(21) Appl. No.: 16/475,155

(22) PCT Filed: Dec. 28, 2017

(86) PCT No.: PCT/KR2017/015696

§ 371 (c)(1),
(2) Date: Jul. 1, 2019

(87) PCT Pub. No.: WO2018/124793

PCT Pub. Date: Jul. 5, 2018

(65) Prior Publication Data

US 2019/0328611 A1 Oct. 31, 2019

(30) Foreign Application Priority Data

Dec. 29, 2016 (KR) ..... 10-2016-0181913
Dec. 26, 2017 (KR) ..... 10-2017-0179286

(51) Int. Cl.
*A61H 33/06* (2006.01)
*E03D 9/08* (2006.01)

(52) U.S. Cl.
CPC ..... *A61H 33/06* (2013.01); *E03D 9/08* (2013.01); *A61H 2033/068* (2013.01); *A61H 2201/105* (2013.01)

(58) Field of Classification Search
CPC ..... A61H 33/06; E03D 9/08
USPC ..... 4/420.2
See application file for complete search history.

(56) References Cited

FOREIGN PATENT DOCUMENTS

| | | | |
|---|---|---|---|
| JP | 2007-224512 | A | 9/2007 |
| KR | 10-2000-0024184 | A | 5/2000 |
| KR | 10-2007-0012900 | A | 1/2007 |
| KR | 10-2007-0078749 | A | 8/2007 |
| KR | 20-2010-0008849 | U | 9/2010 |
| KR | 10-2012-0024333 | A | 3/2012 |
| KR | 10-2012-0113190 | A | 10/2012 |
| KR | 10-2014-0067038 | A | 6/2014 |
| KR | 10-2016-0131536 | A | 11/2016 |

OTHER PUBLICATIONS

KR 10-2000-0024184 A English translation printed Sep. 14, 2020 (Year: 2020).*

* cited by examiner

*Primary Examiner* — Christine J Skubinna
(74) *Attorney, Agent, or Firm* — Novick, Kim & Lee, PLLC; Jae Youn Kim

(57) ABSTRACT

Provided is a bidet device. The bidet device according to the present invention comprises: a seat as a place to sit; a steaming chamber housing which is imbedded in a bidet tank coupled to one side of the seat and has built-in parts therein; a nozzle for hip fumigation, which is connected to the steaming chamber housing for jetting medicinal steam; and a steam generator which is provided in the steaming chamber housing and connected to the nozzle for hip fumigation, allowing the medicinal steam and medicinal extracts generated for hip-fumigation bath to be supplied to the nozzle for hip fumigation, wherein the steam generator and a medicine container of the steaming chamber disposed in the steaming chamber housing are integrally installed to eject the fumigated medicinal steam and medicinal extracts of drugs into a stool.

4 Claims, 11 Drawing Sheets

BIDET DEVICE

TECHNICAL FIELD

The present invention relates to a bidet device, and more particularly, to a bidet device capable of contributing to health improvement by enabling the hip-fumigation bath using a medicinal steam, which, first of all, allows a compact device to be implemented so that its installation or maintenance can be facilitated.

BACKGROUND ART

Conventionally, a steam generator having a structure which steams a substance beneficial to the human body and send it to a toilet seat for hip-fumigation bath was proposed by the applicant of the present invention as Korean Patent Application No. 2001-13020, which is configured as shown in FIG. 1.

The steam generator is configured such that a water tank 101 is installed at one side of the steam generator 100, a water bath 102 having a heating element 103 is formed in the vicinity of the water tank 101, and a mugwort box reservoir portion 104 for storing a net colander-shaped mugwort box 105 is formed to be communicated with the water bath 102 on the upper portion of the water bath 102.

On the upper side of the mugwort box reservoir portion 104, a steam outlet 106 for sending mugwort fumigation to a toilet seat 120 through a steam transfer pipe 107 is provided. At the lower part of the mugwort box reservoir portion 104, a drainage induction pipe 108 is formed for draining liquid material generated by a condensation phenomenon of mugwort extract.

In addition, a steam outlet 121 for appropriately feeding the mugwort steam transferred from the steam generator 100 into the toilet seat 120 is installed in the toilet seat 120 which is connected to the steam transfer pipe 107.

Hereinafter, the operation of the conventional steam generator as configured above will be described.

Water is supplied from the water tank 101 to the water bath 102, water in the water bath 102 is heated by the heating element 103 to generate steam. The steam moves to the mugwort box reservoir portion 104 through a steam communicating pipe 109 communicating between the water bath 102 and the mugwort box reservoir portion 104, and steams mugworts in the mugwort box 105 which is installed to be engaged in the mugwort box reservoir portion 104. The mugwort steam steamed by the steam passes through the steam outlet 106 and the steam transfer pipe 107 which are formed at one side of the upper portion of the mugwort box reservoir portion 104, and then the steam is blown into the toilet seat 120 through a steam spout 121 installed in the toilet seat 120 so that the hip-fumigation bath can be performed.

Therefore, in the case of women as well as men, when considering the physical structure and the place of fomentation, it is possible to perform the hip-fumigation bath with comforting and stable mind by using the toilet which is a closed space, thereby bringing great help to the space utilization and the health promotion.

However, the above technique has several disadvantages as follows.

The conventional steam generator as described above has disadvantages that when the mugwort is fumigated, since the mugwort extract of liquid substance generated by the condensation phenomenon, etc. flows into the water bath 102 through the steam communicating pipe while being collected to the lower portion of the mugwort box reservoir portion 104, the water contained in the water tank 102 may be contaminated and unsanitary and the devices such as the heating element 103 are easily aged.

In addition, a steam ejecting hole 121 for guiding and feeding the mugwort steam delivered from the steam generator 100 into the toilet seat 120 is provided as a single body as shown in FIG. 2, and half-circular inlet ports 121*a* and 121*b* which are formed on both sides of the steam ejecting hole 121 are fixed and tightened by a bolt 123*a* and a nut 123*b* which are fastening members of the hinge axis 122*a* and 122*b*.

Since a hip fumigator with the steam generator 100 of FIG. 1 and the et bedded steam generator 1 of FIG. 3 is installed on the floor of a toilet, it occupies a complicated space, the toilet seat is not fixed at a predetermined place and is detached when cleaning the toilet, and thus causing malfunction, breakdown, or breakage. Therefore there was a risk of electric shock due to current flows when the bottom of the toilet and the hip fumigator are wetted.

In addition, the medicinal extract solution steamed in the steaming chamber has a structure that flows out to the floor of the toilet like the drainage induction pipe 108 shown in FIG. 1, so that there was a trouble that the floor of the toilet soiled with extracted liquid foreign substance has to be cleaned from time to time.

Therefore, in order to compensate these faults, a compact device that implemented the function of the hip fumigation in the bidet tank is necessary, and it is necessary to develop a technology for a bidet device capable of dramatically improving safety and convenience and easily performing installation or maintenance.

PRIOR ART DOCUMENT

Patent Documents (Patent Document 1) Korean Patent Application No. 10-2015-0064082

(Patent Document 2) Korean Patent Application No. 10-2012-0033709

(Patent Document 3) Korean Patent Application No. 10-2007-0043969

(Patent Document 4) Korean Patent Application No. 10-2005-0067126

DISCLOSURE

Technical Problem

It is an object of the present invention to provide a bidet device capable of contributing to health improvement by implementing the function of the hip fumigation in a bidet tank to safely and conveniently perform the hip-fumigation bath using a medicinal steam, and first of all, which allows a compact device to implementing so that its installation or the maintenance can be facilitated.

Technical Solution

In order to achieve the above object, the present invention provides a bidet device may comprise: a seat as a place to sit; a steaming chamber housing which is imbedded in a bidet tank coupled to one side of the seat and has built-in parts therein; a nozzle for hip fumigation, which is connected to the steaming chamber housing for jetting medicinFal steam; and a steam generator which is provided in the steaming chamber housing and connected to the nozzle for hip fumigation, allowing the medicinal steam and medicinal extracts generated for hip-fumigation bath to be supplied to the nozzle for hip fumigation, wherein the steam generator and a medicine container of the steaming chamber disposed in the steaming chamber housing may be integrally installed to eject the fumigated medicinal steam and medicinal extracts of drugs into a toilet seat.

The medicines for hip-fumigation may be applied in a non-woven fabric type so as to be replaceable.

The steam supplying line may comprise: a straight line section which is connected to the steam generator and the medicine container of the steaming chamber, the end of which passes through the medicines for hip-fumigation to be disposed to the upper portion of the medicines for hip-fumigation; and a bending section which is communicated with the straight line section to be bent at an upper end of the straight line section.

Also, a lid for replacing medicines, or opening and closing the opening of the steaming chamber housing, or the medicine container of the steaming chamber may be provided on one side of a bidet tank.

The lid may comprise: a shielding plate portion for shielding the opening of the seaming chamber housing or the medicine container of the steaming chamber; and a skirt portion which is extended from an end of the shielding plate portion and fitted in a space between the steaming chamber housing and the medicine container of the steaming chamber.

In addition, the bidet device may further comprise: an input unit for inputting an input signal for hip-fumigation bath; and a controller for controlling the operation of the steam generator based on the input signal from the input unit.

The bidet device is provided with a genuine product detection sensor for detecting whether or not the medicine for hip-fumigation is genuine on the inner side of the medicine container of the steaming chamber, thereby identifying a trademark, a Q mark, a bar code, or a Quick Response (QR) code which indicate a genuine product of the medicine for hip-fumigation, which allows a warning sound to be generated depending on its identification on whether the medicine for hip-fumigation is genuine, and to prohibit the use by not allowing to be operated or discharged when the medicine for hip-fumigation is not genuine.

The nozzle for hip-fumigation may be installed so as to be variable in length with reference to a fixed portion wherein a middle portion of the first and second length adjusting portions is formed of nonconductive material, and a magnet is provided at the upper and lower end portions, wherein depending on power supply, when in use, the magnet may be detached to adjust the length of the first, second, and third length adjusting portions to be long and when not in use, the magnet is attached to a metal plate to shorten the length of the first, second, and third length adjusting portions.

The nozzle for hip-fumigation is provided in a JAVARA type so that the length thereof can be adjusted.

The nozzle for hip fumigation may be provided with an ejection hole at one end thereof which is detachable through a fastening groove and a fastening protrusion.

Advantageous Effects

A bidet device according to the present invention contribute to health improvement by enabling the hip-fumigation bath using a medicinal steam, which, first of all, allows a compact device to be implemented so that its safety and convenience can be improved and its maintenance and repair can be facilitated.

BEST MODE

Figure 1:
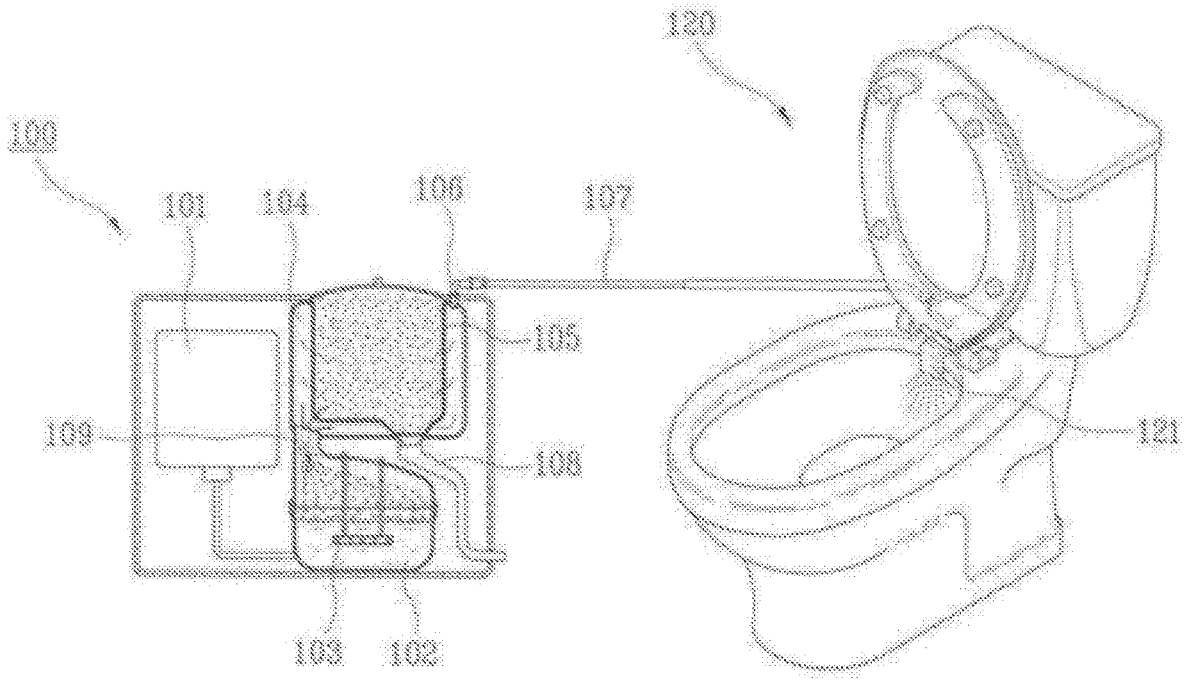
FIG. 1 PRIOR ART
FIG. 1 is a view illustrating a steam generator and a toilet seat according to an embodiment of a related art.
Figure 2:
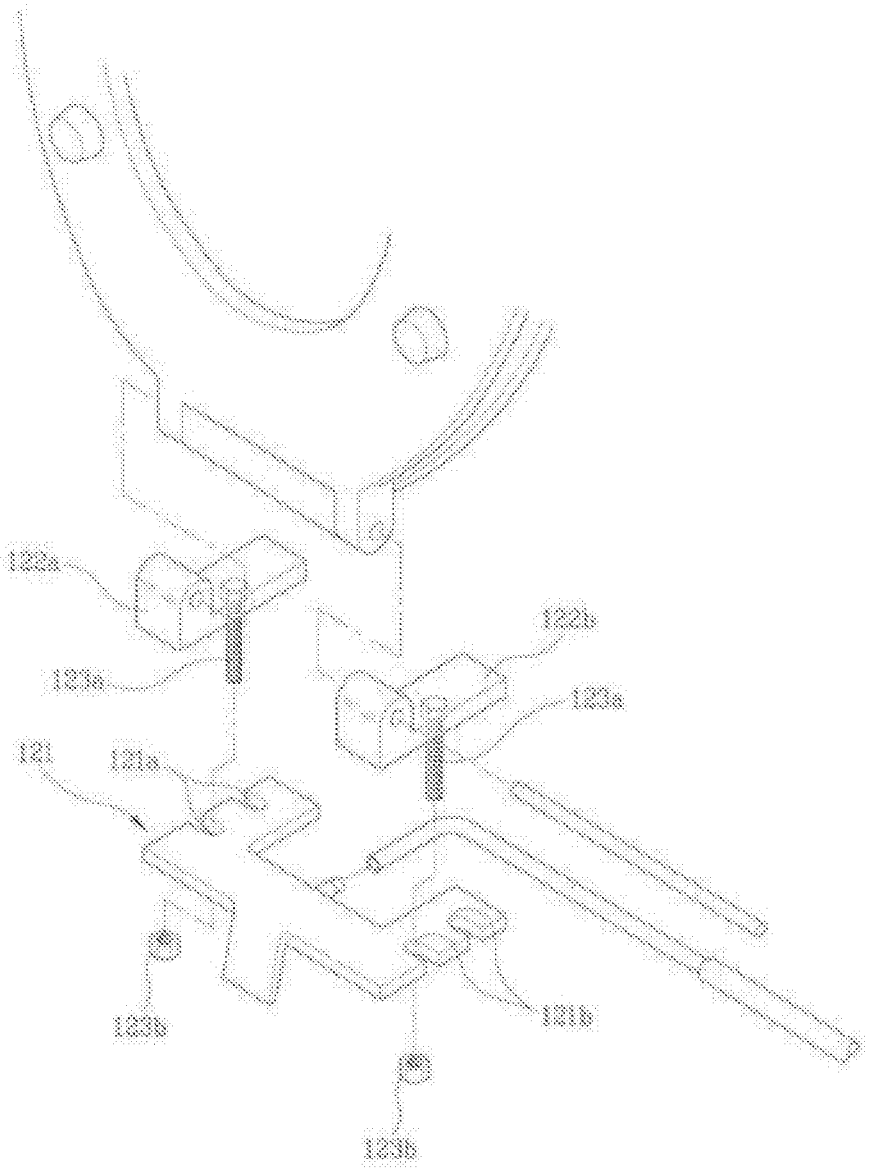
FIG. 2 PRIOR ART
FIG. 2 is an exploded perspective view illustrating a steam ejection hole of FIG. 1.
Figure 3:
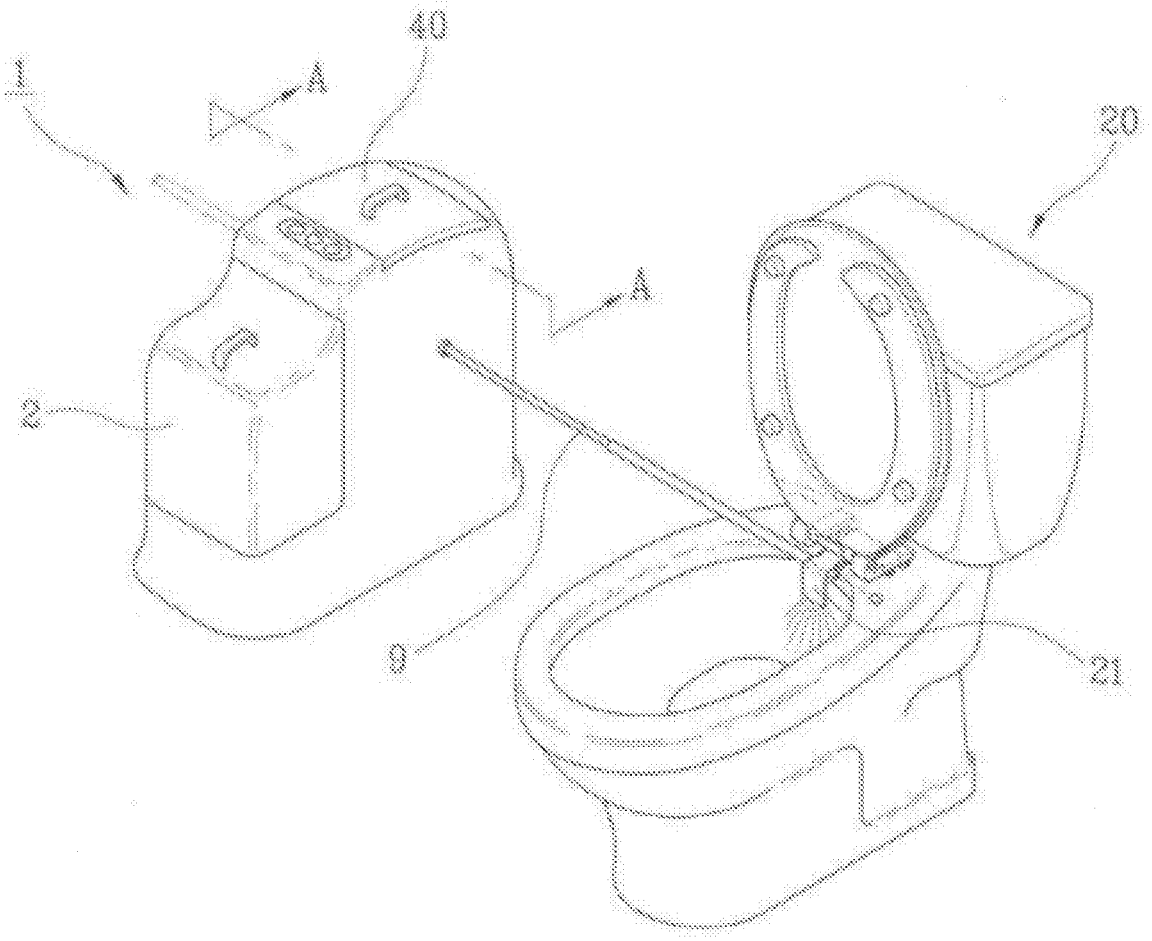
FIG. 3 PRIOR ART
FIG. 3 is a view illustrating a steam generator according to another embodiment of related art.

Hereinafter, embodiments according to the present invention will be described in detail with reference to the accompanying drawings so that those skilled in the art to which the present invention pertains can easily practice.

However, the description of the present invention is only an example for structural or functional explanation, and the scope of claims of the present invention should not be construed to be limited by the embodiment described in the specification.

For example, the embodiment according to the present invention may be changed variously and have various types, and thus it should be understood that it includes all equivalents to achieve a technical spirit within a scope of the present invention.

Also, since the embodiments suggested in the present invention do not mean that these should include either all of the object and the effect or only the effect, these embodiments should not be construed to limit the scope of claims of the present invention.

In this specification, these embodiments are provided so that this disclosure will be thorough and complete, and will fully convey the scope of the disclosure to those skilled in the art. The present invention is only defined by the scope of the claims.

As such, in some embodiments, well known components, operations, and techniques are not specifically described to avoid an undesirable interpretation of the present invention.

Meanwhile, it is to be understood that the meaning of the terms described in the present invention is not limited to a dictionary meaning, and should be understood as follows.

It is to be understood that when one element is referred to as being "connected to" another element, it may be connected directly to another element or be connected to another element having the other element intervening therebetween. On the other hand, it is to be understood that when one element is referred to as being "connected directly to" another element, it may be connected to another element without the other element intervening therebetween. The meanings of other expressions to describe the relationship between components, i.e. the terms "~between" and "immediately ~between" or "adjacent to" and "directly adjacent to" should be interpreted in the same manner.

Singular forms are intended to include plural forms unless the context clearly indicates otherwise. It will be further understood that the terms "comprises" or "have" used in this specification specify the presence of stated features, numerals, steps, operations, components, parts, or a combination thereof, but do not preclude the presence or addition of one or more other features, numerals, steps, operations, components, parts, or a combination thereof.

Unless indicated otherwise, it is to be understood that all the terms used in the specification has the same meaning as those that are understood by those skilled in the art.

The terms commonly used and predefined terms should be interpreted to be consistent with the meanings in the context of the related art, and cannot be interpreted as having ideal or excessively formal meaning unless explicitly.

Hereinafter, exemplary embodiments of the present invention will be described in detail with reference to the accompanying drawings. The same reference numerals will be used to describe the same components and an overlapped description of the same components will be omitted.

Figure 4:
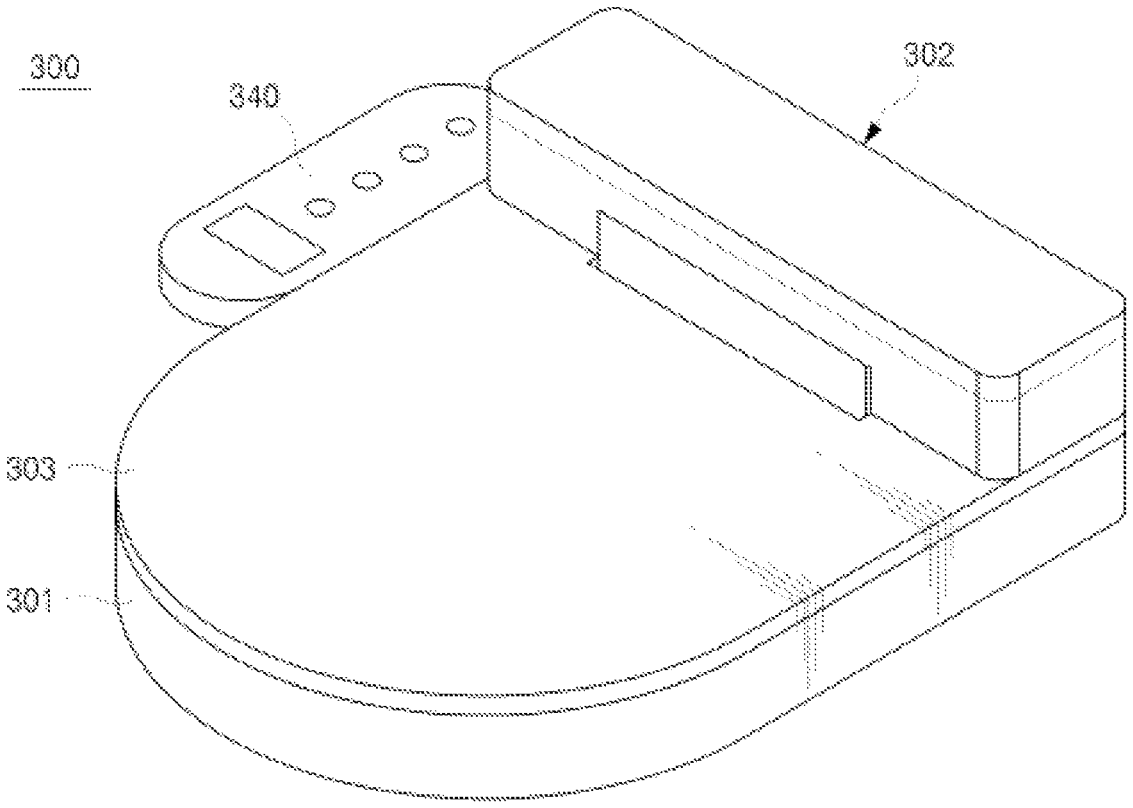
FIG. 4 is a perspective view illustrating a bidet device according to a first embodiment of the present invention.
Figure 5:
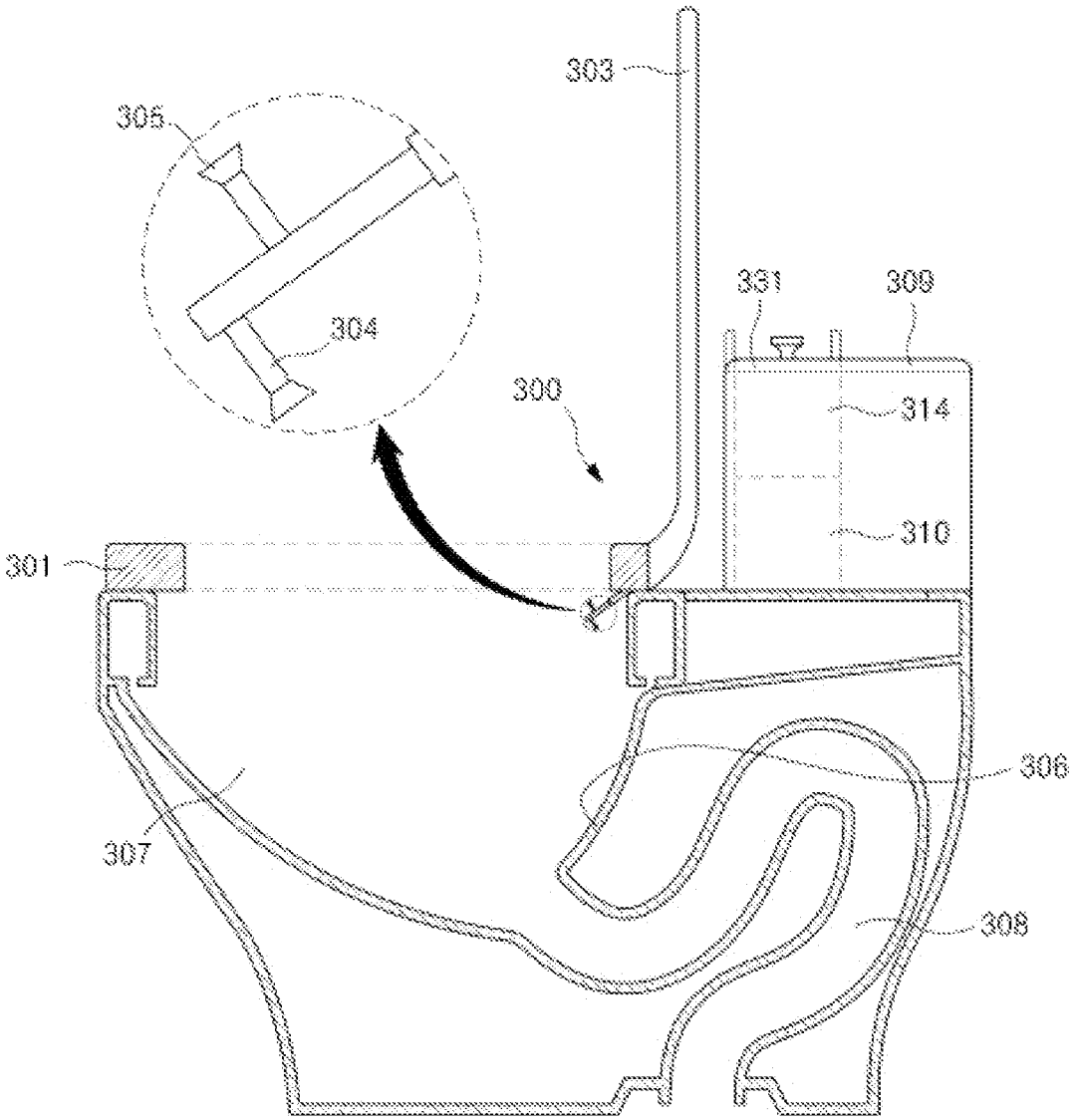
FIG. 5 is a view illustrating an installing state of FIG. 4.
Figure 6:
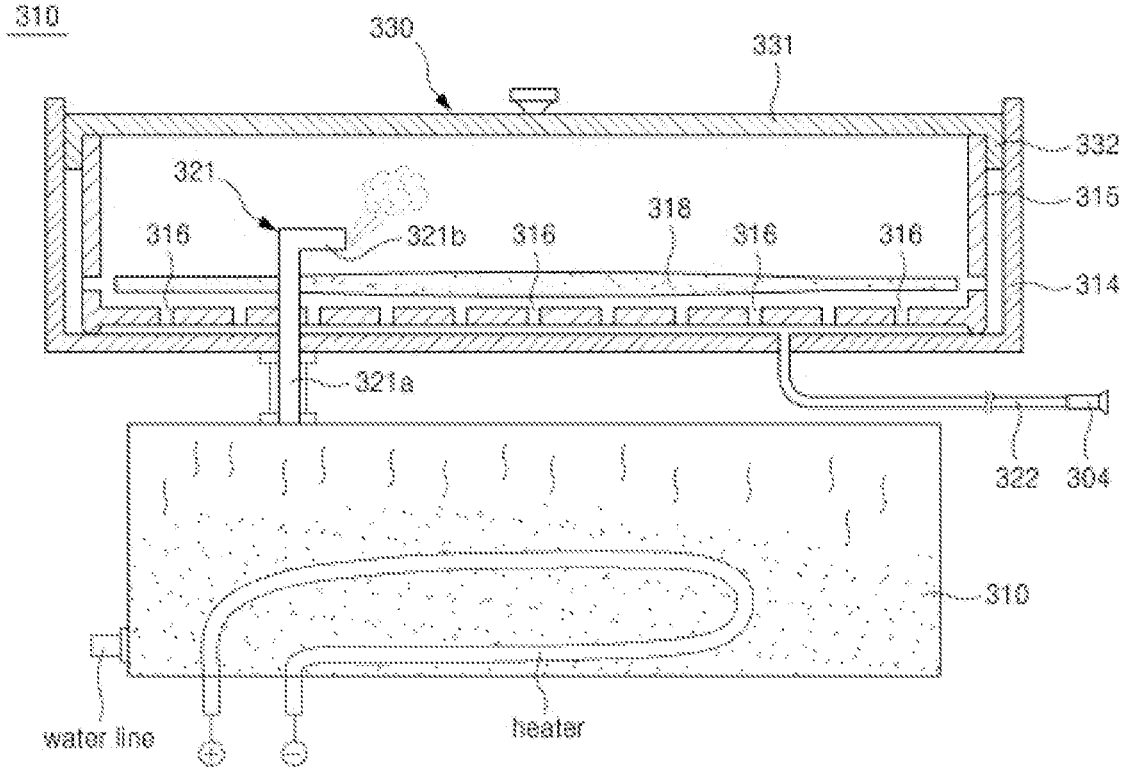
FIG. 6 is a view illustrating a steam generator according to an embodiment of the present invention.
Figure 7:
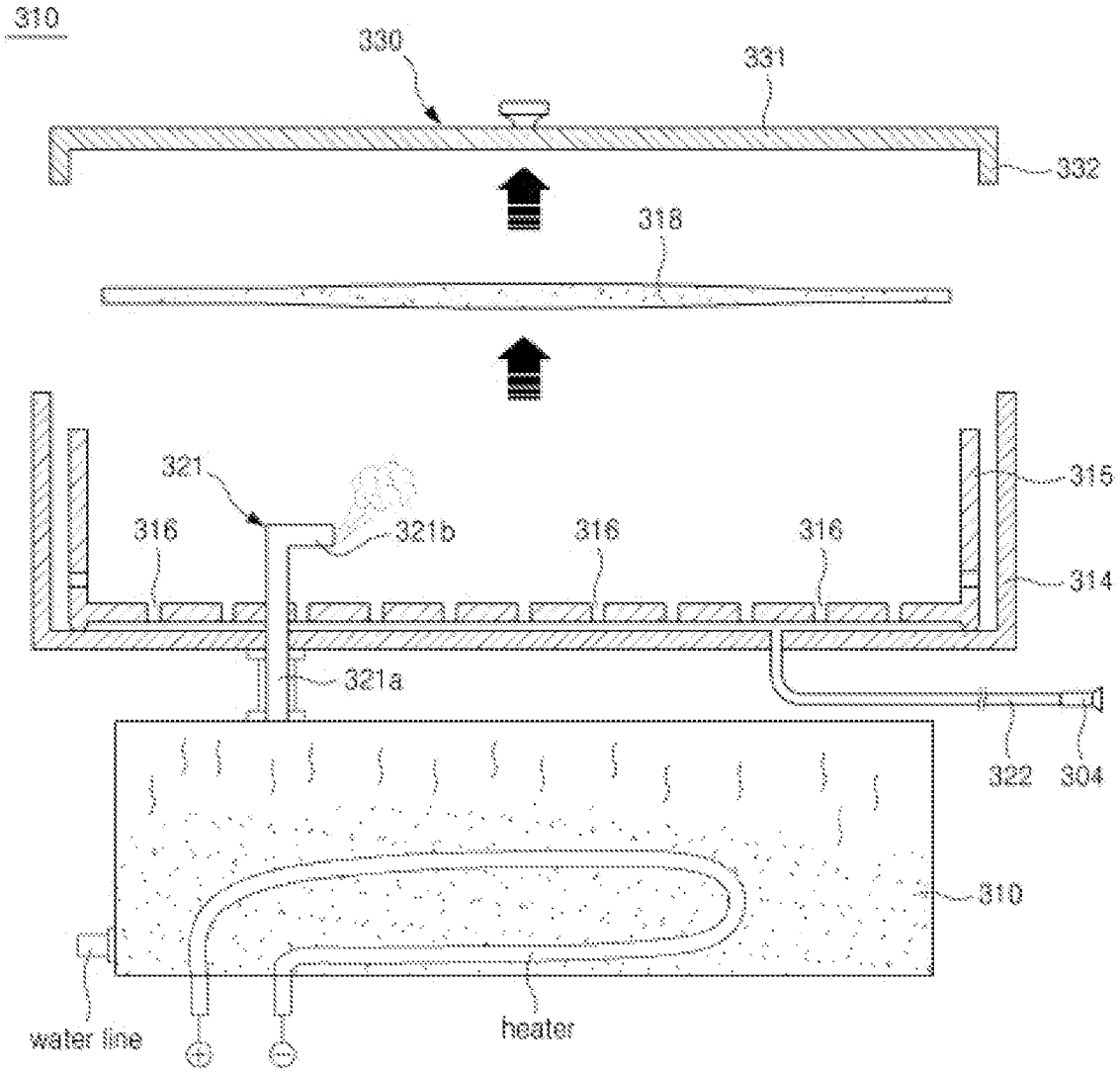
FIG. 7 is an exploded perspective view illustrating a steam generator shown in FIG. 6.
Figure 8:
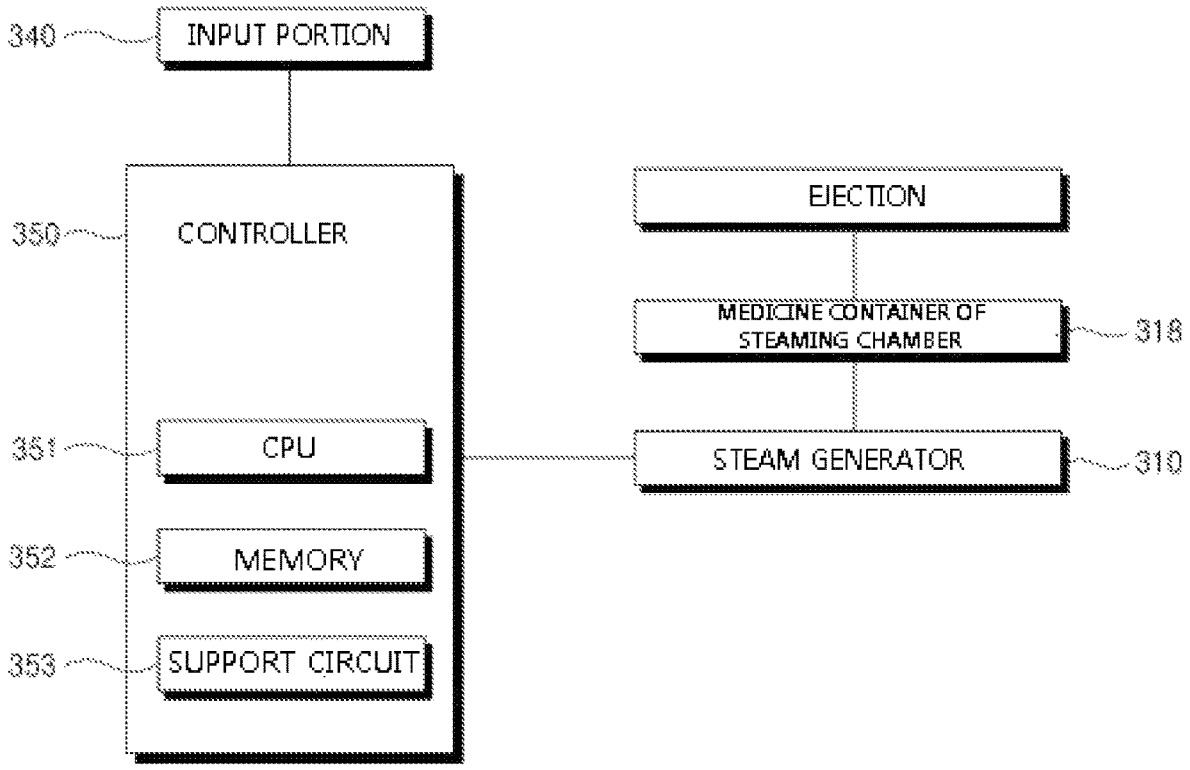
FIG. 8 is a flowchart for controlling a bidet device shown in FIG. 4.

FIG. 4 is a perspective view illustrating a bidet device according to a first embodiment of the present invention, FIG. 5 is a view illustrating an installing state of FIG. 4, FIG. 6 is a view illustrating a steam generator according to an embodiment of the present invention, FIG. 7 is an exploded perspective view illustrating a steam generator shown in FIG. 6, and FIG. 8 is a flowchart for controlling a bidet device shown in FIG. 4.

Referring to the drawings, a bidet device 300 according to the present embodiment contributes to health improvement by hip-fumigation with a medicinal steam, and particularly, the bidet device can be compacted to improve safety and convenience and thus easily maintained and repaired.

The bidet device 300 is embedded into a bidet tank 309 coupled to an upper portion of a body 306 of a toilet seat, as shown in FIG. 5.

Referring briefly to a structure of a toilet seat, a water storing space 307 is formed inside the body 306 of a toilet seat and a discharge tube passage 308 in a curved shape is proved on the lower portion of the water storing space. Accordingly, the urination is discharged together with the water in the water storing space 307 along the discharge tube passage 308.

Meanwhile, the bidet device 300 according to an embodiment of the present invention, which can be coupled to the toilet seat as shown in FIG. 5, includes a seat plate 301, a cover 303, a nozzle for hip-fumigation 304 and a steam generator 301.

The seat plate 301 provides a seat to sit. The seat plate 301 may be arranged on an upper end of a toilet body 306. A cover for opening and closing the opening of the seat plate 301 is coupled to the seat plate 301.

The steam generator 310 and the steaming chamber housing 314 of a hip-fumigation device are arranged in an embedded component chamber of a bidet tank 309.

The nozzle for hip-fumigation 304 is coupled to the steaming chamber housing 314. This nozzle for hip-fumigation 304 is provided separately from a nozzle for bidet wherein the nozzle for hip-fumigation ejects in an opposition to the nozzle for bidet, that is, downwardly.

The steam generated in the embedded type steam generator 310 is introduced into the steaming chamber housing 314 to steam the medicine for hip-fumigation 318. The steaming medicinal steam and steaming extract collide with the wall inside the toilet body 306 through the nozzle for hip-fumigation 304, thereby enjoying a hip-fumigation bath at a lowered temperature.

The procreating organ and excretion organ of human body are composed of constrictor wherein the steaming medicinal steam supplied through the nozzle for hip-fumigation 304 activates the function of constrictor of the procreating organ and excretion organ of human body, thereby preventing and treating various diseases to improve health.

Meanwhile, the embedded type steam generator 310 is provided within the bidet tank 309 to be coupled to the steaming chamber housing 314 wherein it serves to generate medicinal steam and then to be ejected together with the medicinal extract to the nozzle for hip-fumigation 304 for hip-fumigation bath.

As in the present embodiment, when the steam generator 310 is provided within the bidet tank 309, it can improve safety and convenience and it can be easily installed and maintained and repaired.

Specially, there is advantage that the medicine for hip-fumigation 318 can be replaced easily. The steaming chamber housing 314 may be arranged within the bidet tank 309 for replacing the medicine for hip-fumigation 318. Here, a lid 330 is provided on an upper portion of the bidet tank 309, which is opened and closed for replacing the medicine for hip-fumigation, so that the steaming chamber housing 314 is cleaned, maintained and repaired with opening the lid 330, or the medicine for hip-fumigation 318 which is packaged with non-woven fabric within the steaming chamber housing 314 is replaced simply.

The steam generator 310 is a device for generating steam. The steam generator 310 is configured as a heater or boiler type to generate steam by heating water. The medicinal steam generated from the steam generator 310 is introduced into the steaming chamber housing 314 for hip-fumigation which is provided on one side of the steam generator 310.

The steam introduced into the steaming chamber housing 314 is to steam the medicine contained in a medicine container 315 of the steaming chamber and is ejected while colliding with the inner wall of the toilet seat through the medicinal steam ejection line 322.

More detailed structure of the steam generator 310 will be omitted for convenience, referring to the descriptions previously filed by the present applicant.

The medicine container for steaming the medicine is provided in the steaming chamber housing 314, with which a plurality of through-holes 316 are provided.

The medicine container 315 is arranged within the steaming chamber housing 314. The plurality of through-holes 316 are formed through all of bottom and side walls of the medicine container 315 of the steaming chamber.

The lid 330 is provided for opening and closing the openings of the steaming chamber housing 314 or the medicine container 315 of the steaming chamber. The lid 330 according to the present embodiment includes a shield plate portion 331 for shielding the openings of the steaming chamber housing 314 or the medicine container 315 of the steaming chamber and a skirt portion 332 which is extended from an end of the shield plate portion 331 and is fitted into a space between the steaming chamber housing 314 and the medicine container 315 of the steaming chamber.

Since the skirt portion 332 is configured to be fitted into a space between the steaming chamber housing 314 and the medicine container 315 of the steaming chamber, the diffusing and loss of the steam can be reduced. Further, the steam can be prevented from being spread out. At this time, the end of the steaming chamber housing 314 is higher a little than the skirt portion 332 and thus it guides the steam to eject upward not to side surface when the steam ejects.

The medicine for hip-fumigation 318 is provided within the medicine container 315 of the steaming chamber, which is formed to medicinal steam by the steam from the steam generator 310. In the present embodiment, the medicine for hip-fumigation 318 may be provided in a non-woven fabric type which is replaceable. The medicine for hip-fumigation 318 may include mugwort medicine prepared in a non-woven fabric type.

Further, a genuine product detection sensor(not shown) for determining whether the genuine product of the medicine for hip-fumigation is or not is provided at an inner side of the medicine container 315 of the steaming chamber, thereby determining whether the medicine for hip-fumigation provided within the medicine container 315 of the steaming chamber is genuine or not.

For this purpose, the genuine product detection sensor identifies a trademark, a Q mark, a bar code, or a Quick Response (QR) code which indicate a genuine product of the medicine for hip-fumigation, which allows a warning sound to be generated depending on its identification on whether the medicine for hip-fumigation is genuine or not, and prohibits the use by not allowing to be operated or discharged when the medicine for hip-fumigation is not genuine.

The support line 321*a* is connected to the steam generator 310 and the medicine container 315 of steaming chamber, allowing the steam generated from the steam generator 310 to be supplied to the medicine 318 for hip-fumigation within the medicine container 315 of the steaming chamber.

The steam supply line 321*a* is connected to the steam generator 310 and the medicine container 315 of steaming chamber wherein it may include a straight line section 321*a* end of which passes through the medicines for hip-fumigation 318 to be disposed to the upper portion of the medicines for hip-fumigation 318 and a bending section 321*b* which is communicated with the straight line section 321*a* to be bent at an upper end of the straight line section 321*a*. As in the present embodiment, the bending section 321*b* is formed on the steam supply line 321*a* thereby to increase a generation efficiency of medicinal steam. Further, the steam supply line can be prevented from being clogged with residues. Specially, the steam supply line 321*a* is manufactured in an elbow type so that the condensed water drops including the medicinal extract can be prevented from being introduced into the steam generator 310.

One end of the medicinal steam ejection line 322 is arranged between the steaming chamber housing 314 and the medicine container 315 of the steaming chamber and the other end thereof is coupled to the nozzle for hip-fumigation 304, and it serves to eject the medicinal steam to the nozzle for hip-fumigation.

Meanwhile, the bidet device 300 according to the present embodiment is further provided with an input portion 340 and a controller 350.

The input portion is a kind of button for inputting an input signal for hip-fumigation bath. Further, the controller 350 controls the operation of the steam generator 310 based on the input signal from the input portion 340. That is, the medicinal steam, for example, mugword steam is ejected by the operation of the steam generator 310 through the nozzle for hip-fumigation.

This controller 350 may include a CPU 351, a MEMORY 352, and a SUPPORT CIRCUIT 353.

The CPU 351 may be one of various computer processors which are applicable in industry to control the operation of the steam generator 310 based on the input signal from the input portion 340.

The MEMORY 352 is connected to the CPU 351. The MEMORY is a record media which is readable through a computer, and it may be arranged at a local or a remote site wherein, for example, the MEMORY may be one or more of memories which can be used easily such as a random access memory(RAM), a read only memory(ROM), a floppy disk, a hard disk or a random digital storage device.

The SUPPORT CIRCUIT 353 is connected to the CPU 351 to support a typical operation of a processor. The SUPPORT CIRCUIT 353 may include a cash, a power supply, a clock circuit, input/output circuit, a subsystem and the like.

In the present embodiment, the controller 350 controls the operation of the steam generator 310 based on the input signal from the input portion 340. At this time, a series of process for controlling the operation of the steam generator 310 based on the input signal from the input portion by the controller 350 may be stored in the MEMORY 352. Typically, the software routine may be stored in the MEMORY 352. The software routine may be further stored or executed by another CPU (not shown).

Even though it is described that the process is executed by the software routine, at least a part of the processes according to the present invention can be executed by hardware. As such, the processes of the present invention may be implemented by the software that is executed on a computer system, implemented by hardware such as an integrated circuit or implemented by the combination of the software the hardware.

When the input portion 340 is operated by this configuration, the steam generator 310 is operated to supply the steam through the steam supply line 321*a*, and the supplied steam is converted into the medicinal steam while passing through the medicine for hip-fumigation 318 and is ejected into the nozzle for hip-fumigation through a medicinal steam ejection line 322, thereby enjoying healthy hip-fumigation bath.

According to the present embodiment having the configurations and effects as described above, the hip-fumigation bath using the medicinal steam is possible to contribute to the healthy improvement, and the bidet device can be compacted to improve safety and convenience, and installed and maintained and repaired easily.

Figure 9:
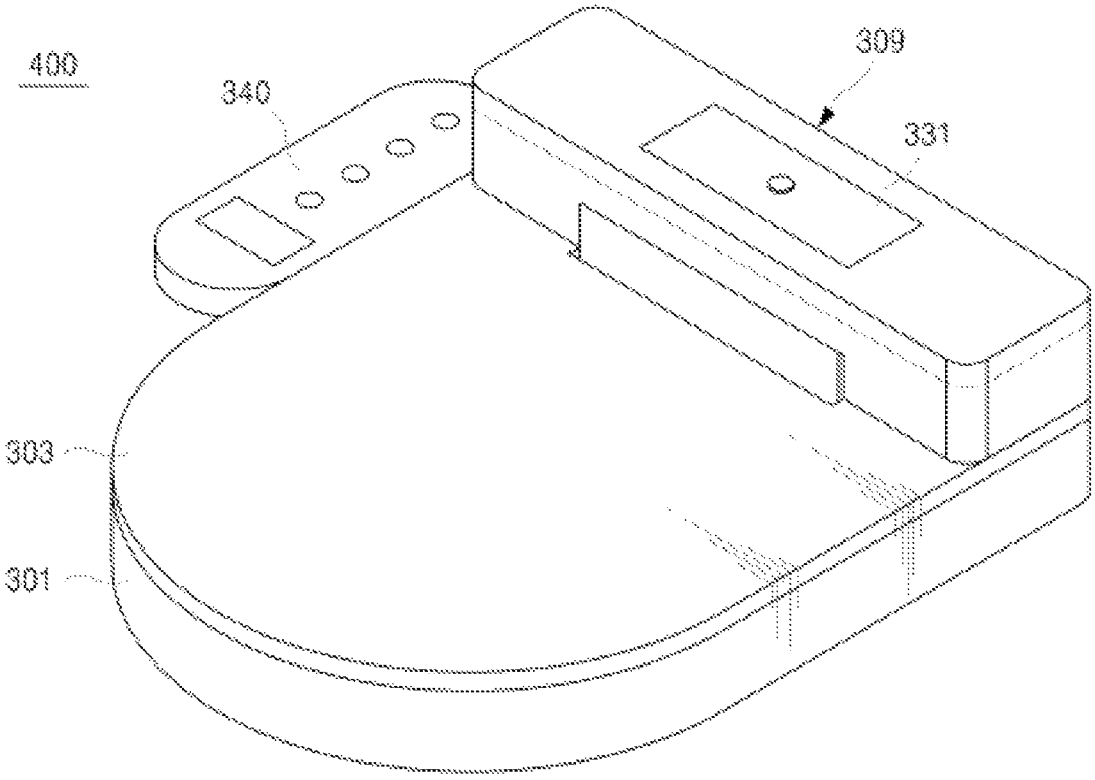
FIG. 9 is a perspective view illustrating a bidet device according to a second embodiment of the present invention.

FIG. 9 is a perspective view illustrating a bidet device according to a second embodiment of the present invention.

Referring to the drawing, the bidet device 400 according to the present embodiment also is a configuration where the embedded type steam generator 310 (referring to FIG. 5) is embedded within a bidet tank 309.

In the configuration as described above, the lid 330 is exposed outside in the steaming chamber housing 314 of the steam generator 310. In this case, there is an advantage that the medicine for hip-fumigation 318 (referring to FIG. 6) is replaced easily with opening the lid 330.

When the present embodiment is applied, the hip-fumigation bath with the medicinal steam is possible as well to contribute to health improvement and the bidet device can be compacted to improve safety and convenience, and installed and maintained and repaired easily.

Figure 10:
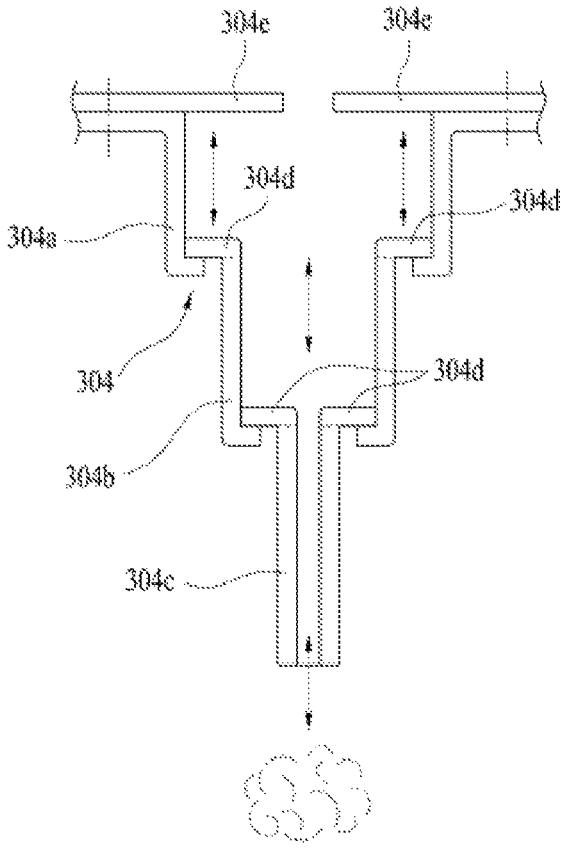
FIG. 10 is a view illustrating a nozzle for hip-fumigation, the length of which is adjustable by using a magnet of the present invention.
Figure 11:
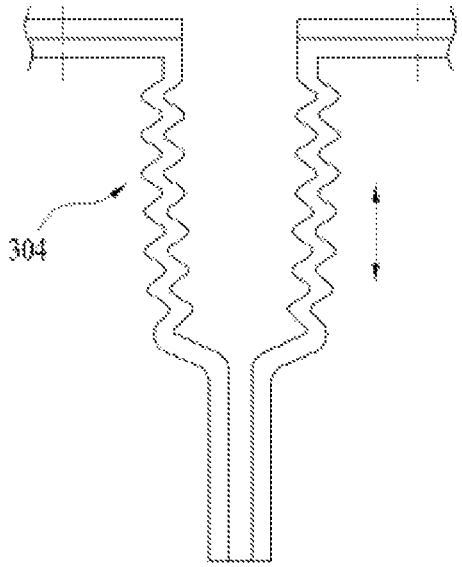
FIG. 11 is a view illustrating a nozzle for hip-fumigation, the length of which is adjustable in a javara type of the present invention.
Figure 12:
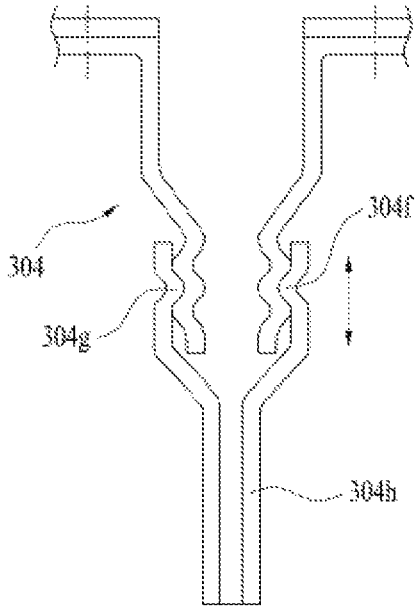
FIG. 12 is a view illustrating a detachable nozzle for hip-fumigation of the present invention.

In case of the nozzle for hip-fumigation 304 according to another embodiment, as shown in FIGS. 10 to 12, various configurations may be applied.

For example, as shown FIG. 10, the nozzle for hip-fumigation 304 is installed so as to be variable in length with reference to a fixed portion and in this case, a middle portion of the first and second length adjusting portions 304*a*, 304*b* is formed of nonconductive material, and a magnet 304*d* is provided at the upper end of the third length adjusting portion 304*c* wherein depending on power supply, when in use, the magnet is detached to adjust the length of the first, second and third length adjusting portions 304*a*, 304*b*, 304*c* to be long, and when not in use, the magnet 304*d* of the first, second and third length adjusting portions 304*a*, 304*b*, 304*c* is attached to the attaching piece 304*e* made of a metal plate to shorten the length thereof.

Further, as shown in FIG. 11, a part of the nozzle for hip-fumigation 304 is provided in a javara type so that the length thereof can be adjusted, if necessary.

Meanwhile, as shown in FIG. 12, a fastening groove 304*f* and a fastening protrusion 304*g* which are fastened elastically are provided on one side of the nozzle for hip fumigation 304, thereby improving convenience in using it. As a result, a disposable ejection hole 304*h* is provided at one end thereof, which is detachable through the fastening groove 304*f* and the fastening protrusion 304*g*, so that the ejection hole 304*h* which is unsanitary or disgusted due to contamination from excretion can be replaced and used, thereby solving displeasure.

The present invention is not limited to the embodiments described herein, and it is apparent to those skilled in the art that various changes and modifications may be made without departing from the spirit and scope of the present invention. Therefore, such examples of change or modification should be understood to be included in the claims of the present invention.

The invention claimed is:

1. A bidet device, comprising:

a steaming chamber housing disposed in a bidet tank;

a medicine container disposed in the steaming chamber housing and configured to hold medicine for hip fumigation, wherein a plurality of through-holes are formed on bottom and side walls of the medicine container;

a nozzle for hip fumigation, connected to the steaming chamber housing for ejecting medicinal steam, wherein the nozzle for hip fumigation is extended in a direction opposite to that of a nozzle for bidet; and a steam generator disposed in the bidet tank and connected to the steaming chamber housing for generating steam;

a steam supplying line connected to the steam generator and the steaming chamber housing to supply the steam generated in the steam generator to the medicine in the medicine container, wherein the steam supplying line includes a straight section extended from an inner bottom surface of the steaming chamber housing to pass through the medicine such that an end of the straight section is disposed over an upper portion of the medicine, and a bending section extended from the end of the straight section to be bent from the straight section such that an end of the bending section is directed substantially in parallel with the inner bottom surface of the steaming chamber housing;

a lid including a shielding plate portion for shielding opening of the steaming chamber housing or the medicine container, and a skirt portion which is extended from an end of the shielding plate portion to be fitted in a space between the steaming chamber housing and the medicine container; and a medicinal steam ejection line having one end which is located between the steaming chamber housing and the medicine container and another end which is coupled to the nozzle for hip fumigation to eject the medicinal steam to the nozzle for hip fumigation.

2. The bidet device according to claim 1, wherein the medicine container includes a genuine product detection sensor for detecting whether or not the medicine is genuine by identifying a trademark, a Q mark, a bar code, or a Quick Response (QR) code which indicates a genuine product of the medicine, and generating a warning sound depending on its identification on whether the medicine for hip fumigation is genuine, or prohibiting its use by not allowing to be operated or discharged when the medicine is not genuine.

3. The bidet device according to claim 1, wherein the nozzle for hip fumigation is configured to be variable in length with reference to a fixed portion and includes a first, a second, and a third length adjusting portions, wherein a middle portion of each of the first, the second, and the third length adjusting portions is formed of nonconductive material, and a magnet is provided at an upper portion of each of the second and the third length portions, such that, depending on power supply, when in use, the magnet is detached from a metal plate on the first adjusting portion to increase the length of the nozzle for hip fumigation, and when not in use, the magnet is attached to the metal plate to shorten the length of the nozzle for hip fumigation.

4. The bidet device according to claim 1, wherein the nozzle for hip fumigation has a fastening groove and a fastening protrusion on its outer surface at one end thereof to which an ejection hole is detachably connected through the fastening groove and the fastening protrusion.

* * * * *